US007666231B2

(12) United States Patent
Lion

(10) Patent No.: US 7,666,231 B2
(45) **Date of Patent: *Feb. 23, 2010**

(54) PROCESS FOR CONTINUOUS PRODUCTION OF A FLOCKED AND DYED CLOTH BACKING

(75) Inventor: Jean-Pierre Lion, Laval (FR)

(73) Assignee: Societe d'Enduction et de Flockage, Laval (FR)

( * ) Notice: Subject to any disclaimer, the term of this patent is extended or adjusted under 35 U.S.C. 154(b) by 408 days.

This patent is subject to a terminal disclaimer.

(21) Appl. No.: 11/196,285

(22) Filed: Aug. 4, 2005

(65) Prior Publication Data

US 2006/0029767 A1 Feb. 9, 2006

(30) Foreign Application Priority Data

Aug. 4, 2004 (FR) ..... 04 08625
May 27, 2005 (FR) ..... 05 05379

(51) Int. Cl.
*B05D 1/14* (2006.01)

(52) U.S. Cl. ..... 8/488; 8/494; 8/922; 427/206

(58) Field of Classification Search ..... 8/115.51, 8/488, 494, 922; 156/230; 427/206
See application file for complete search history.

(56) References Cited

U.S. PATENT DOCUMENTS

| | | | | |
|---|---|---|---|---|
| 4,273,817 | A | 6/1981 | Matsuo et al. | |
| 4,294,577 | A * | 10/1981 | Bernard | 8/488 |
| 5,284,900 | A * | 2/1994 | Izubayashi et al. | 524/492 |
| 5,981,021 | A | 11/1999 | McCulloch | |
| 6,224,707 | B1 * | 5/2001 | Lion | 156/230 |
| 2004/0041298 | A1 * | 3/2004 | Jen | 264/172.13 |
| 2004/0053001 | A1 * | 3/2004 | Abrams | 428/90 |

FOREIGN PATENT DOCUMENTS

| | | |
|---|---|---|
| EP | 0 913 271 A1 | 5/1999 |
| EP | 1 088 677 A1 | 4/2001 |
| JP | 2000265367 | 9/2000 |

* cited by examiner

*Primary Examiner*—Lorna M Douyon
*Assistant Examiner*—Amina Khan
(74) *Attorney, Agent, or Firm*—Young & Thompson

(57) ABSTRACT

In this process of continuous manufacture of a flocked and dyed cloth backing (S) comprising successive stages of application (1) of a polymerizable resin (RP) layer to at least one surface of the cloth backing, projection (2) of white or unbleached polyester flock fibers (FF) onto said resin layer, polymerization (3) of the resin to fix the flock fibers on the cloth backing, deposition (4) of at least one sublimable dye (E) on the flocked surface of the cloth backing and sublimation (4) of the deposited dye to dye the flocked fibers, for the stage of projection (2), polyester super microfibers are used with a titer of less than 0.5 Dtex and a length of between 0.2 and 0.5 mm.

3 Claims, 2 Drawing Sheets

PROCESS FOR CONTINUOUS PRODUCTION OF A FLOCKED AND DYED CLOTH BACKING

This invention relates to a process for continuous production of a flocked and dyed cloth backing.

Obtaining monochrome flocked surfaces with a given shade is well known and well managed. "Flock" fibers are prepared by their manufacturer and dyed to the desired shade by conventional textile dyeing processes. These dyed fibers are then applied by the classic process of "flocking" and are fixed on a backing by implantation in a polymer resin layer. The final color of the flocked product is then obtained by a combination of the initial shade of the "flock" fibers, the density of these fibers that are applied to the backing, and the pigmentation of the resin in which the fibers are implanted. This process of obtaining monochrome flocked surfaces is widely used. It has several disadvantages, however, both for the flock manufacturer and for the industrial user:

- for the flock manufacturer, production in medium quantities of several thousand meters of flocked products in a given uniform color calls for several hundred kilograms of "flock" fibers that are dyed to the given desired shade (roughly 200 kg of "flock" fibers per 2000 $m^2$ of the manufactured flocked product); the dyeing and finishing of such a quantity of textile fibers lead to significant wastes of dyes and textile finishing agents that themselves dictate onerous operations of waste water treatment as well as frequent operations of draining and cleaning manufacturing and dyeing materials;
- at the site of the industrial user of "flock" fibers, this same production in medium quantities entails major dead times in production as a result of the operations of cleaning machinery that are essential between each change of shade; by way of example, production of 2000 $m^2$ of flocked product in a given shade can take from 3 to 4 hours of production time and the preparation and machinery cleaning time can take half the production time; segmented production, moreover, increases systematic losses caused by the production process.

On the other hand, use of white or unbleached fibers to produce flocked products is known. The use of white or unbleached fibers has multiple advantages both for the "flock"fiber manufacturer and for the industrial user:

- for the "flock" fiber manufacturer, elimination of the operations of textile dyeing and elimination of the use of dyeing materials, which leads to savings in material and energy, reduction of wastes, elimination of waste water treatment operations, and major improvement in industrial efficiency by the significant increase of quantities produced relative to the fibers;
- for the industrial user of "flock" fibers, major improvement in productivity by reducing the cleaning time and downtime of the machinery (time that can make up 50% of the production time); reduction of losses and wastes caused by changes of color and by cleaning; and elimination of messy work for employees.

Obtaining a flocked and dyed product from white or unbleached fibers is obviously possible by a supplementary printing operation carried out in steps on the flocked white or unbleached product.

Among the printing techniques, printing-sublimation that is applicable to certain synthetic fibers allows continuous production (in rolls) of flocked and dyed products, either plain or reproducing a given monochrome or polychrome pattern.

This operation is conventionally carried out in steps. More exactly, after the flocked product has been produced, a temporary preprinted paper with sublimable inks is placed in contact with the flocked product, and the combination is raised for several seconds to a temperature of close to 200° C. that can initiate sublimation of the pigments contained in the ink used. The impression carried by the temporary paper is thus faithfully "transferred" hot to the flocked backing, by imparting to the latter a dyed appearance, plain or multicolored, depending on the graphic characteristics of the temporary preprinted paper.

This process of printing-sublimation, used by the holder of this patent application to continuously print his flocked articles, is described especially in documents EP-A-0 913 271 (or U.S. Pat. No. 6,224,707) and EP-A-0 993 963 (or U.S. Pat. No. 6,249,297). These two documents call for use of polyamide or polyester "flock" fibers, of which the "titer" (diameter) is between 0.5 Dtex and 20 Dtex, and whose length is between 0.3 mm and 3 mm.

The polyamide fibers, for example of "Nylon 6" or "Nylon 6-6" (filed trademarks), resist rather well the crushing caused by the printing-sublimation operation, during which the "flock" fibers are subjected to the combined effect of heat—roughly 200° C. to 210° C.—and the application pressure of the preprinted paper on the flocked backing. Conversely, resistance to washing and rubbing, dry and wet, of the shades obtained in this way on the polyamide fibers as well as the brightness of these shades are weak.

On the other hand, polyester fibers lead to impressions with very good fastness or resistance to washing, rubbing, light . . . and they allow shades that are lively and bold to be obtained. Under the conditions described in the aforementioned documents, the polyester "flock" fibers, however, have the disadvantage of lying down under the combined action of temperature and pressure during the printing-sublimation operation. This results in that the "flock" fibers on the surface of the flocked and dyed backing exhibit an unattractive crushing and general orientation. The feel of the flocked surface is rough, at least in one direction, i.e., in the direction corresponding to the passage of a finger "the wrong way," and the printed surface is flat and crushed.

This crushing phenomenon could be limited by reducing the intensity of the pressure applied during the printing-sublimation operation. Perfect and stable contact, however, must be maintained between the flocked backing and the preprinted temporary paper for the entire printing-sublimation operation. If this were not the case, any movement, however tiny, of one of the two elements relative to the other during this operation would impart a blurred or "smeared" appearance to the impression obtained on the flocked support. This is because the fact of having to maintain close contact between the preprinted paper and the flocked backing during the entire printing-sublimation operation obviously implies application of a certain pressure to the combination and a guarantee that this pressure is entirely constant and very uniform. A compromise must thus be found, on the one hand, between a pressure strong enough to maintain close contact between the preprinted paper and the flocked backing, and, on the other hand, a pressure weak enough to prevent crushing of the "flock" fibers of the flocked backing during the printing-sublimation operation. Such a compromise is difficult to achieve, and, in any case, it does not allow complete satisfaction to be provided at the same time for the sharpness of the impression obtained and a soft feel of the flocked surface of the backing.

The adverse effect of crushing that is caused by the printing-sublimation operation could be limited by using as the flocking adhesive a polymer resin with an elevated softening and melting point, or by a selection of polyester fibers with improved resistance to temperature, such as, for example, "PCT"-type fibers. The improvement obtained with polymer resins with little thermal sensitivity is significant, but it does not prevent a preferred orientation of the "flock" fibers. There are fibers with improved thermal resistance, but they are only available in titers exceeding 1.5 Dtex, and the printed flocked product obtained with these fibers still maintains a "rough" touch. The use of such fibers is thus possible, but the result obtained is not satisfactory with respect to the "feel" of the flocked product.

Thus, the object of this invention is to devise a process that makes it possible to obtain, from white or unbleached fibers, a flocked and dyed product with an extremely soft feel, without orientation and invulnerable to the action of temperature (this process does not disrupt the possible orientation of the "flock" fibers imparted to the flocked layer before the sublimation operation).

To do this, the object of the invention is a process of continuous manufacture of a flocked and dyed cloth backing comprising stages of successive application of a polymerizable resin layer to at least one surface of the cloth backing, projection of white or unbleached polyester flock fibers onto said resin layer, polymerization of the resin to fix the flock fibers on the cloth backing, deposition of at least one sublimable dye to the flocked surface of the cloth backing, and sublimation of the deposited dye to dye the flock fibers, characterized in that for the stage of projection, super microfibers of polyester with a titer of less than 0.5 Dtex and a length of between 0.2 and 0.5 mm are used.

As will be seen in details below, these super microfibers impart to the flocked surface an exceptionally soft feel and have the advantage of being essentially invulnerable to crushing when they are exposed to the combined action of heat and pressure during the stage of deposition and sublimation of the dye(s) (transfer printing and sublimation). This property is surprising and unexpected since until the present it was commonly and logically accepted that fibers of greater diameter (titer) have increased resilience. Moreover, this property allows use of flocked products with these super microfibers in applications such as thermobonding, thermoforming or thermocompression (hot molding of pieces covered by a flocked backing) or decoration in mold that is better known to those skilled in the art under the name "decoration in mold," or other similar operations, without its leading to crushing of the flock fibers and without changing either the visual appearance or the very soft feel of the flocked product. In "decoration in mold," a plastic material is injected into a mold whose cavity has a surface that is at least partially covered by a flocked plastic film whose flock fibers are rotated toward the inside surface of the mold cavity.

The process of this invention can, moreover, have one or more of the following characteristics:

- the super microfibers used have a titer of roughly 0.3 Dtex;
- the super microfibers used have a length of roughly 0.3 mm;
- the super microfibers used have a length of roughly 0.4 mm;
- as the polymerizable resin, a 100% solid resin is used, with a high softening point, preferably a softening point above 170° C., for example a polyurethane resin;
- as a polymerizable resin, a resin with weak adhesive power is used, for example an acrylic resin in a modified aqueous dispersion,
- in one embodiment of the process of the invention, the deposition stage of at least one sublimable dye consists in a transfer printing operation;
- in another embodiment of the process of the invention, the stage of deposition of at least one sublimable dye consists in an inkjet printing operation.

Other objectives, characteristics and advantages of the invention will appear during the following description of two embodiments of the invention given by way of example with reference to the attached drawings, in which.

Figure 1:
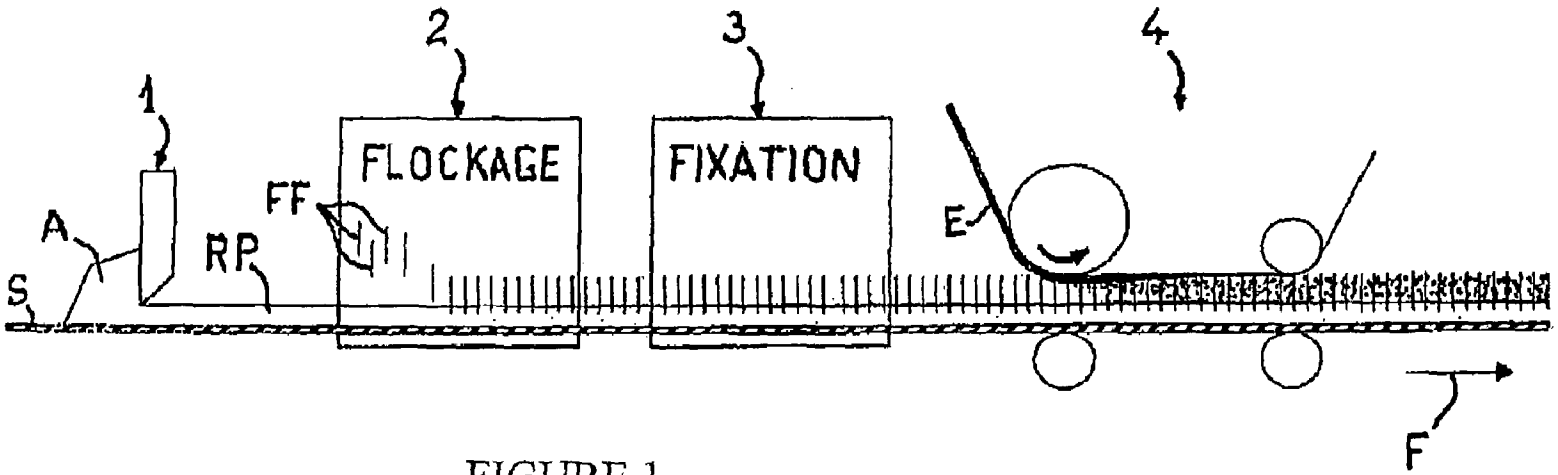
FIG. 1 is a schematic diagram illustrating the main stages of the process according to a first embodiment of the invention.

Referring to FIG. 1, it is apparent that the process according to the invention comprises a first stage 1 that consists in applying a layer of adhesive A (polymerizable resin RP) to the surface of a backing S that continuously runs in the direction indicated by the arrow F, a second stage 2 or flocking stage consisting in projecting "flock" fibers FF onto the polymerizable resin RP layer, a third stage 3 or fixing stage consisting in having the resin of the adhesive A polymerize in order to fix the bottom of the flock fibers FF in the resin, the free portion of said flock fibers FF extending essentially perpendicular to the surface of the resin layer, and a fourth stage 4 or printing-sublimation stage consisting in depositing at least one ink E containing at least one sublimable dye and having the sublimable dye(s) contained in the ink sublimate in order to dye the flock fibers FF.

The backing S can be selected from a wide range of backings that can be flocked, such as paper, cardboard, plastic film, woven material, or nonwoven material. In the case in which the backing S is composed of plastic film, in certain cases, before treatment by the process of the invention or before stage 4 of the latter, the backing can be advantageously stabilized by thermal bonding of the plastic film onto a temporary backing in a manner similar to that described in the document EP-A-0 993 963 already mentioned above. In any case, the backing S can be present in the form of a roll that is placed on a delivery spool (not shown in FIG. 1) using which the roll is unwound continuously for implementing the operations of stages 1 to 4 of the process according to the invention.

In stage 1, the polymer resin RP used as the adhesive A can be deposited as a thickened and/or thixotropic aqueous emulsion (acrylic or polyurethane resins) in the form of plastisols, or else, in a preferred version of the invention, in the form of 100% solid or "high solid" liquid resins, which can be polymerized by thermal means or by irradiation (by ultraviolet or electron beams). These latter resins, 100% solid or "high solid," have the advantage of being able to exhibit a very high softening point, which can be useful when the backing S, once flocked, is then subjected to heat treatments at relatively elevated temperatures. One example of a "high solid" resin that can be used for stage 1 is the "IMPRANIL-IMPRAFIX" system from the BAYER Company, Germany.

In the case in which the flock fibers FF must be fixed temporarily on the backing S, for example when the flock fibers FF of the flocked and dyed backing obtained by the process of the invention must be able to be transferred entirely or partially to another backing, for example a textile backing, after having been covered completely or selectively, depending on the case, by an operation of coating or by a screen printing operation, with a hot-setting adhesive layer ("hot-melt thermofusible"-based system) during subsequent treatment of the flocked and dyed backing, a resin with weak adhesive power is used as the polymerizable resin RP. For this temporary fixing of the flock fibers, for example, an acrylic resin can be used that is deposited in a modified aqueous dispersion in a limited quantity, for example from 30 to 60 gr/m$^2$ (weight of dry resin).

As wished or required, the polymer resin RP layer used as the adhesive A can be coated uniformly or according to a given pattern, for example by serigraphic coating on a rotary frame. The resin layer has a final thickness of between 15 and 100 μm, depending on the nature of the flock fibers FF used for the second stage (flocking stage 2). Generally, the finer the titer and the shorter the length of the "flock" fibers used, the smaller the thickness of the polymerizable resin layer can be.

During stage 2, the white or unbleached flock fibers FF are projected into the polymer resin RP layer by any one of the conventional flocking techniques that are well known and thus do not need to be described in detail.

In the process of the invention, polyester super microfibers (standard polyester of the PET type) with a titer of less than 0.5 Dtex and a length of between 0.2 and 0.5 mm are used as the flock fibers to obtain a flocked backing with a very soft feel.

In one preferred version of the invention, super microfibers of PET are used that have a titer close to 0.3 Dtex and that are cut to a length of 0.3 or 0.4 mm. These fibers are marketed by the company VELUTEX-FLOCK S.A. in GRANOLLERS, Spain.

These PET super microfibers impart to the flocked surface an exceptionally soft feel and have the advantage of being essentially invulnerable to crushing when they are exposed to the combined action of heat and pressure. This surprising and unexpected property (it is commonly and logically accepted that fibers of greater diameter have increased resilience) allows use of flocked products with these fibers in applications such as thermobonding, thermoforming, thermocompression or "decoration in mold," without its leading to crushing of the "flock" fibers and without changing either the visual appearance or the very soft feel of the flocked product.

In stage 3, the polymerizable resin RP is polymerized by irradiation (UV or electron beam) or by thermal means. Polymerization by thermal means can be done by, for example, passing the backing S into a tunnel furnace or over the peripheral surface of a rotating heating drum at a temperature of between 100° C. and 180° C.

In stage 4, deposition and sublimation of the sublimable dye(s) contained in the ink E can be carried out by, for example, an operation of transfer printing and sublimation in a manner similar to that described in the document EP-0 993 963 already mentioned above. Although the technique of transfer printing and sublimation is preferred here, other known techniques can, of course, be used in stage 4 for deposition and sublimation of the ink E on the flocked surface of the backing S without, however, departing from the scope of this invention, as will be seen below regarding the second embodiment.

During stage 4, the sublimable dyes contained in the ink E are activated. They pass into the vapor phase, and they begin to be fixed permanently on the flock fibers FF that have been implanted and fixed on the backing S in stages 2 and 3. If, in stage 4, the ink E had been deposited uniformly in one color, the flocked product with white or unbleached fibers then takes on a uniform shade corresponding to the selected dye formula. On the other hand, if, in stage 4, the ink E has been printed according to a multicolor pattern, the surface of the flocked product will reproduce the original pattern with precision and sharpness, the progression of the gaseous dyes being unidirectional.

After stage 4, the combination composed of the backing S and of the layer of dyed "flock" fibers is cooled by natural cooling or preferably by forced cooling, for example by passage over the peripheral surface of one or more rotating drums cooled by water circulation. In the case in which the backing S is a plastic film stabilized by a temporary backing, the latter is separated from the plastic film and rolled onto a take-up spool with a view to being possibly reused as a temporary backing.

On the other hand, regardless of its nature, the backing S, flocked and dyed, can be wound onto a take-up spool (not shown in the figure) for later use or for possible later treatment, for example "decoration in mold," thermoforming, thermocompression, thermobonding or others.

For purposes of comparison, printing tests of products flocked with classic polyester fibers (1.7 Dtex) and with PET super microfibers according to the invention (0.3 Dtex) were run under the following conditions:

- the backing S was composed of a film made of plastic material such as polyurethane, with a weight per unit of surface area of 150 gr/m$^2$;
- the layer of polymerizable resin RP intended to fix the flock fibers had a weight per unit of surface area of 100 gr/m$^2$ in the case of fibers of 0.3 Dtex according to the invention and a weight per unit of surface area of 150 gr/m$^2$ in the case of classic fibers of 1.7 Dtex;
- the polyester fibers fixed in the resin were super microfibers of 0.3 Dtex (diameter roughly 2 μm) cut to 0.3 and 0.4 mm for fibers of the process according to the invention and fibers of 1.7 Dtex (diameter of roughly 10 μm) cut to 0.5 and 0.6 mm for fibers of the classic process; measurements with a microscope made it possible to measure the length of fibers that remained "free," the portion having penetrated into the adhesive layer being 0.1 mm for the shortest fibers and 0.15 mm for the 0.6 mm fibers; all these values are measured with a precision of +/−12%;
- in all cases, the printing of the flocked surface of the backing S by the transfer and sublimation process took place under a pressure of 2 bars (0.2 MPa) and a temperature of 210° C. for 25 seconds; the thickness of the flocked product before and after printing was measured with a plate comparator, under a constant pressure of 20 gr/cm$^2$ (identical crushing of the fibers in all cases);
- the feel of the flocked surface was evaluated subjectively by three different individuals, a rating of 10/10 being assigned to the flocked layer with the softest super microfibers (0.3 Dtex, 0.4 mm) before any treatment.

| PET Polyester Flocks | Polymer Resin Weight g/m$^2$ | Flocks Weight g/m$^2$ | Thickness Before Printing Resin + Free Flocks μm | Thickness After Printing Resin + Free Flocks μm | Loss on Free Flock Thickness | Feel Before Printing | Feel After Printing |
|---|---|---|---|---|---|---|---|
| 0.3 Dtex 0.3 mm | 250 | 40-45 | 300 + 200 = 500 | 300 + 150 = 450 | −50 μm = 25% | 9/10 | 8/10 |

-continued

| PET Polyester Flocks | Polymer Resin Weight g/m² | Flocks Weight g/m² | Thickness Before Printing Resin + Free Flocks µm | Thickness After Printing Resin + Free Flocks µm | Loss on Free Flock Thickness | Feel Before Printing | Feel After Printing |
|---|---|---|---|---|---|---|---|
| 0.3 Dtex 0.4 mm | 250 | 40-45 | 300 + 300 = 600 | 300 + 210 = 510 | −90 µm = 30% | 10/10 | 9/10 |
| 1.7 Dtex 0.5 mm | 300 | 70-75 | 350 + 400 = 750 | 350 + 210 = 560 | −190 µm = 48% | 6/10 | 3/10 |
| 1.7 Dtex 0.6 mm | 300 | 70-75 | 350 + 470 = 820 | 350 + 250 = 600 | −220 µm = 47% | 6/10 | 3/10 |

The test results are listed in the table above.

Conclusions:

The super microfibers of 0.3 Dtex, cut to 0.3 and 0.4 mm, have a diameter/length ratio of between 0.75 and 1, whereas the ratio of classic fibers of 1.7 Dtex, cut to 0.5 and 0.6 mm, is between 2.8 and 3.4, i.e., it is roughly 3.5 times greater than that of the super microfibers, and the classic fibers are thus 3 to 4 times "stronger" than the super microfibers;

after printing, the loss of thickness of the layer corresponding to the "free" part of the flock fibers is from 25 to 30% in the case of the super microfibers, whereas it is roughly 50% in the case of classic fibers that are still 3.5 times "stronger";

after printing, the super microfibers maintain a very soft feel, whereas the classic fibers, which before printing had a less soft feel than that of the super microfibers, have a clearly degraded feel after printing (50%).

Figure 2:
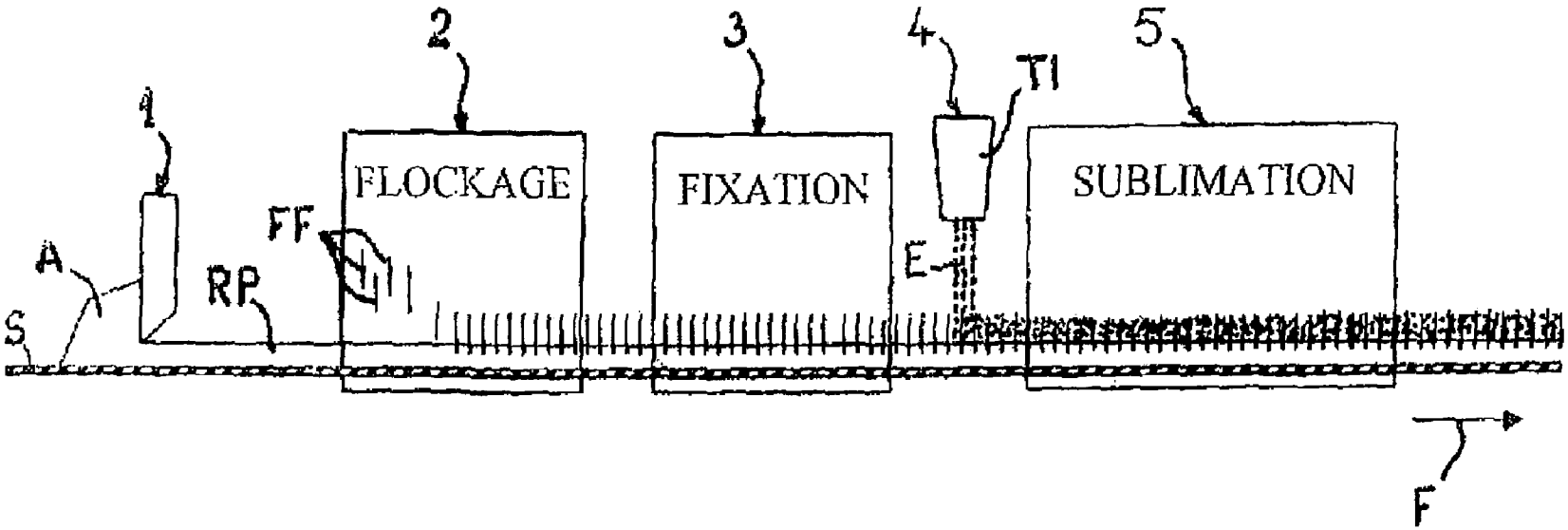
FIG. 2 is a schematic diagram illustrating the main stages of the process according to a second embodiment of the invention.

Let us now refer to FIG. 2 that shows a second embodiment of the process of the invention. In FIG. 2, the stages 1 to 3 are identical to the corresponding stages 1 to 3 of the process of the first embodiment illustrated in FIG. 1, and therefore they will not be described again. The process illustrated in FIG. 2 differs from that of FIG. 1 in that in stage 4, deposition of the sublimable dye(s) onto the flocked surface of the backing S is done by an inkjet printing operation. In other words, in this second embodiment, the sublimable ink(s) are no longer deposited by transfer, but by direct projection of the sublimable ink(s) onto the microfibers covering the flocked backing S using an inkjet printing machine, for example a TX2 model machine manufactured by the MIMAKI Company, Japan, or else a VIPER model machine manufactured by the MUTOH Company, Japan. The printing is done without contact or pressure on the flocked backing, thus without any risk of crushing of flock fibers. Printing can be done with a selection of monochrome or polychrome, over all or part of the flocked surface and in a uniform manner or according to the desired pattern. This embodiment makes it possible to avoid the cost of the preliminary operation of printing of the preprinted temporary paper that in the first embodiment is necessary for the ink transfer/sublimation operation in stage 4 of FIG. 1.

In the second embodiment, the sublimation of the ink(s) projected onto the flocked surface of the backing S is done in stage 5 that took place preferably continuously immediately after stage 4 of printing. To do this, the flocked and printed backing S can be passed into a heating device, such as, for example, into a tunnel furnace, under a ramp of infrared radiation lamps or on the peripheral surface of a heating cylinder that raises said backing S and the ink to a temperature of roughly 200° C. for 30 to 40 seconds. There again, sublimation is done without either contact or pressure on the flocked surface, thus without any risk of crushing of flock fibers. Given that the inkjet printing machines have a relatively limited speed, the length necessary for the heating device can be relatively limited. For example, for a printing speed of 0.5 meter per minute, a heat zone with a dimension of 25 cm in the direction of passage of the backing S will provide a time of exposure to temperature of 30 seconds such that the heating device can be relatively compact.

It goes without saying that the embodiments of the invention that were described above have been given as a purely indicative and by no means limiting example and that numerous modifications can be easily made by one skilled in the art without, however, departing from the scope of the invention. For example, although in the described embodiments, only one of the two surfaces of the cloth backing S is covered by "flock" fibers and dyed, the described process could be applied to two surfaces of the backing S.

The invention claimed is:

1. A process of continuous manufacture of a flocked and dyed cloth backing (S) comprising successive stages of application (1) of a polyurethane resin (RP) layer to at least one surface of the cloth backing, projection (2) of white or unbleached polyethylene terephthalate (PET) flock fibers (FF) onto said resin layer, polymerization (3) of the resin to fix the flock fibers on the cloth backing, deposition (4) of at least one sublimable dye (E) on the flocked surface of the cloth backing and sublimation (4) of the deposited dye to dye the flocked fibers, characterized in that for the stage of projection (2), PET super microfibers are used with a titer of 0.3 Dtex or less and a length of between 0.3 and 0.4 mm.

2. The process according to claim 1, wherein the deposition stage of at least one sublimable dye consists of a transfer printing operation.

3. The process according to claim 1, wherein the stage of deposition of at least one sublimable dye consists of an inkjet printing operation.

* * * * *